US010156039B2

(12) United States Patent
Komarov

(10) Patent No.: US 10,156,039 B2
(45) Date of Patent: Dec. 18, 2018

(54) GARMENTS WITH TWO-WAY PLEATED ELEMENTS AND METHODS FOR MANUFACTURING THEREOF

(71) Applicant: Shelley Komarov, Pacific Palisades, CA (US)

(72) Inventor: Shelley Komarov, Pacific Palisades, CA (US)

( * ) Notice: Subject to any disclaimer, the term of this patent is extended or adjusted under 35 U.S.C. 154(b) by 369 days.

(21) Appl. No.: 15/018,878

(22) Filed: Feb. 9, 2016

(65) Prior Publication Data

US 2017/0226688 A1 Aug. 10, 2017

(51) Int. Cl.

| | |
|---|---|
| ***D06J 1/00*** | (2006.01) |
| ***A41B 1/08*** | (2006.01) |
| ***A41D 1/06*** | (2006.01) |
| ***A41D 1/14*** | (2006.01) |
| ***A41D 1/18*** | (2006.01) |
| ***A41D 1/22*** | (2018.01) |
| ***A41D 27/00*** | (2006.01) |
| ***A41H 43/02*** | (2006.01) |
| ***A41H 3/00*** | (2006.01) |

(52) U.S. Cl.

CPC ..... *D06J 1/00* (2013.01); *A41B 1/08* (2013.01); *A41D 1/06* (2013.01); *A41D 1/14* (2013.01); *A41D 1/18* (2013.01); *A41D 1/22* (2013.01); *A41D 27/00* (2013.01); *A41H 3/007* (2013.01); *A41H 43/0257* (2013.01)

(58) Field of Classification Search

CPC ..... D06J 1/06; A41B 1/08; A41D 1/06; A41D 1/14; A41D 1/18; A41D 1/22; A41D 27/00; A41H 3/007; A41H 43/0257

See application file for complete search history.

(56) References Cited

U.S. PATENT DOCUMENTS

| | | | | |
|---|---|---|---|---|
| 3,823,452 A | | 7/1974 | Harrow | |
| 4,303,459 A | * | 12/1981 | Kleber | D06B 11/0076 156/227 |
| 5,333,765 A | * | 8/1994 | Takizawa | B65B 25/20 223/28 |
| 5,356,055 A | | 10/1994 | Takizawa | |

FOREIGN PATENT DOCUMENTS

| | | |
|---|---|---|
| EP | 0529766 A1 | 3/1993 |
| RU | 2161563 C1 | 1/2001 |

OTHER PUBLICATIONS

Altounian et al. Derwent 2000-687658, 2001.*
Xu et al. Derwent 2005-704240, 2006.*

* cited by examiner

*Primary Examiner* — Amina S Khan
(74) *Attorney, Agent, or Firm* — Georgiy L. Khayet

(57) ABSTRACT

A method for manufacturing of garments comprises the steps of obtaining a pattern of a garment, cutting at least one fabric according to the pattern into a plurality of fabric pieces, attaching the plurality of fabric pieces together to create an unfinished garment, and forming a final garment by pleating the unfinished garment. The pleating step creates at least one one-way pleated element and at least one two-way pleated element in the final garment. Pleats of the at least one one-way pleated element and pleats of the at least one two-way pleated element are created without securing the pleats in place.

18 Claims, 3 Drawing Sheets

GARMENTS WITH TWO-WAY PLEATED ELEMENTS AND METHODS FOR MANUFACTURING THEREOF

BACKGROUND

Technical Field

This disclosure generally relates to pleated garments. More particularly, this disclosure relates to garments having a combination of one-way and two-way pleated fragments created in a single pleating operation. This disclosure also relates to methods and systems for manufacturing these garments.

Description of Related Art

The approaches described in this section could be pursued, but are not necessarily approaches that have been previously conceived or pursued. Therefore, unless otherwise indicated herein, the approaches described in this section are not prior art to the claims in this application and are not admitted to be prior art by inclusion in this section.

Pleating of fabrics is widely known in the art. In general, pleating is a process of forming pleats, which involves folding a piece of fabric back onto itself to create pleats and securing the pleats in place. Pleats typically lie parallel to one another. The securing of pleats can be accomplished by stitching at one end so as to hold the pleated folds in place.

Pleating techniques are conventionally used in the clothing industry, which allow for gathering a wide piece of fabric to a narrower circumference. Many couture designers use pleating techniques to add structure and texture to clothing. Today, there are known several pleating methods including hand pleating and machine pleating. Some examples of known pleating techniques include Egyptian pleating, Miao pleating, Mariano Fortuny pleating, Issey Miyake pleating, Reiko Sudo pleating, and so forth.

The known pleating techniques for manufacturing pleated garments include two general steps. At a first step, prior to construction of a garment, fabric pieces are separately pleated and the pleats are secured in place by binding with stitching. At a second step, a garment is constructed by attaching the pleated fabric pieces together. These techniques, however, limit design variations of garments and complicate the overall garment manufacturing process.

SUMMARY

This section is provided to introduce a selection of concepts in a simplified form that are further described below in the Detailed Description section. This summary is not intended to identify key features or essential features of the claimed subject matter, nor is it intended to be used as an aid in determining the scope of the claimed subject matter.

In one aspect of this disclosure, there is provided a method for manufacturing of a garment. The method comprises the steps of: obtaining a pattern of the garment, wherein the pattern accounts for one or more pleated elements; cutting at least one fabric according to the pattern into a plurality of fabric pieces; attaching the plurality of fabric pieces together to create a single, unfinished garment; and forming a final garment by pleating the entire unfinished garment to create at least one one-way pleated element and at least one two-way pleated element, wherein the at least one one-way pleated element and the at least one two-way pleated element are created in a single pleating operation.

In certain embodiments, pleats of the at least one one-way pleated element and pleats of the at least one two-way pleated element are created without securing the pleats in place. The pleating operation can be performed only after the attachment of the plurality of fabric pieces into the unfinished garment.

In certain embodiments, the method may further comprise attaching one or more additional fabric pieces to the final garment after the pleating operation. The pleating of the entire unfinished garment may include the steps of: stacking the entire unfinished garment on a shaped paper; folding the shaped paper together with the entire unfinished garment; heating the shaped paper with the entire unfinished garment in a heater; and separating the entire unfinished garment from the shaped paper after the heating operation.

In some embodiments, the heating step includes heating in a steam box during a predetermined period being in the range of about 20 minutes to about 40 minutes and at a predetermined temperature being in the range of about 180 F to about 200 F. In other embodiments, the heating step includes compressing the shaped paper together with the entire unfinished garment by a press during a predetermined period being in the range of about 1 minute to about 2 minutes and at a predetermined temperature being in the range of about 420 F to about 400 F.

In certain embodiments, the method may further comprise coloring the final garment. The coloring can be performed during the pleating operation or after the pleating operation is fully completed.

In some embodiments, the coloring step includes performing sublimation of at least one dye by attaching one or more pieces of dye sublimation heat transfer paper to the final garment, and compressing the one or more pieces of dye sublimation heat transfer paper with the final garment in a press. In an alternative embodiment, the coloring includes performing sublimation of at least one dye by attaching one or more pieces of dye sublimation heat transfer paper to the unfinished garment, and compressing the one or more pieces of dye sublimation heat transfer paper with the unfinished garment in a press. In some embodiments, at the coloring step, a paper form of a predetermined shape can be attached to the final or unfinished garment before the compressing, wherein the paper form facilitates creation of a predetermined silhouette of the final garment.

In certain embodiments, the at least one one-way pleated element includes a fragment of the final garment, which is pleated in a repeated manner with pleats being substantially parallel to each other. The at least one two-way pleated element includes a fragment of the final garment, which is pleated in a repeated manner with first pleats being substantially parallel to each other and directed in a first direction and second pleats being substantially parallel to each other and directed in a second direction. The at least one two-way pleated element can include a fragment of the final garment having zigzag pleats, basket pleats, or pyramid pleats. In certain embodiments, the at least one two-way pleated element can be connected to the at least one one-way pleated element without breaking a period of pleating.

In another aspect of this disclosure, there is provided a system for manufacturing of a garment. The system may comprise: a computer for obtaining a pattern of the garment, wherein the pattern accounts for one or more pleated elements; a cutting device for cutting out at least one fabric according to the pattern into a plurality of fabric pieces; a sewing machine for sewing a plurality of fabric pieces into a single, unfinished garment; and a pleating device for forming a final garment by pleating the entire unfinished garment to create at least one one-way pleated element and at least one two-way pleated element, wherein the at least one one-way pleated element and the at least one two-way pleated element are created in a single pleating operation. In some embodiments, the system may include a coloring device such as a dye sublimation device for coloring the final garment after the pleating operation is completed.

In yet another aspect of this disclosure, there is provided a garment. The garment comprises: a fabric piece adapted to cover at least one portion of a wearer; at least one one-way pleated element created in a first fragment of the fabric piece; and at least one two-way pleated element created in a second fragment of the fabric piece, wherein the first fragment differs from the second fragment; wherein pleats of the at least one one-way pleated element and pleats of the at least one two-way pleated element are created without securing the pleats in place.

In certain embodiments, the at least one one-way pleated element and the at least one two-way pleated element are created in a single pleating operation. Moreover, the at least one two-way pleated element can be connected to the at least one one-way pleated element without breaking a period of pleating. In some embodiments, the fabric piece includes a plurality of fabric pieces attached together prior to the single pleating operation. In some embodiments, after the at least one two-way pleated element and the at least one two-way pleated element are created, the at least one fabric piece provides a wrinkle-free characteristic. In certain embodiments, the fabric piece is colored during or after the single pleating operation is completed.

Additional objects, advantages, and novel features of the examples will be set forth in part in the description, which follows, and in part will become apparent to those skilled in the art upon examination of the following description and the accompanying drawings or may be learned by production or operation of the examples. The objects and advantages of the concepts may be realized and attained by means of the methodologies, instrumentalities, and combinations particularly pointed out in the appended claims.

BRIEF DESCRIPTION OF THE DRAWINGS

Embodiments are illustrated by way of example and not limitation in the figures of the accompanying drawings, in which like references indicate similar elements and in which.

DETAILED DESCRIPTION OF EXAMPLE EMBODIMENTS

Figure 1:
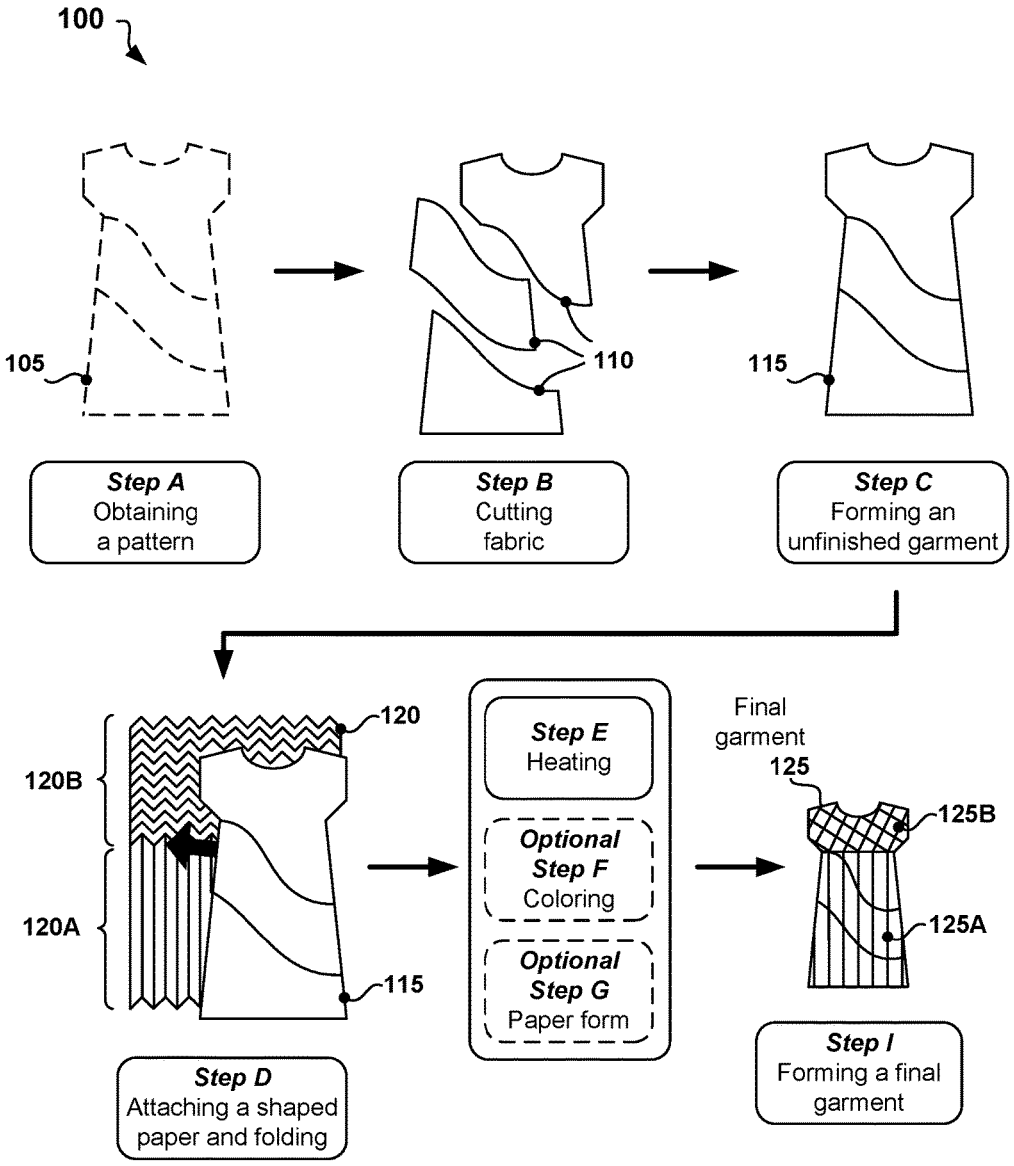
FIG. 1 shows a high-level block diagram of a process for manufacturing a garment.

The following detailed description of embodiments includes references to the accompanying drawings, which form a part of the detailed description. Approaches described in this section are not prior art to the claims and are not admitted to be prior art by inclusion in this section. The drawings show illustrations in accordance with example embodiments. These example embodiments, which are also referred to herein as "examples," are described in enough detail to enable those skilled in the art to practice the present subject matter. The embodiments can be combined, other embodiments can be utilized, or structural, logical and operational changes can be made without departing from the scope of what is claimed. The following detailed description is, therefore, not to be taken in a limiting sense, and the scope is defined by the appended claims and their equivalents.

For purposes of this patent document, the terms "or" and "and" shall mean "and/or" unless stated otherwise or clearly intended otherwise by the context of their use. The term "a" shall mean "one or more" unless stated otherwise or where the use of "one or more" is clearly inappropriate. The terms "comprise," "comprising," "include," and "including" are interchangeable and not intended to be limiting. For example, the term "including" shall be interpreted to mean "including, but not limited to." Additionally, all ranges provided herein include the upper and lower values of the range unless explicitly noted. For example, the term "about" shall mean a reasonable deviation of a value accompanying this term. If it is not specified otherwise, the term "about" refer to a variation of 10% from an indicated value. In the case of a range of values, the term "about" may refer to a 10% variation from both the lower and upper limits of the range.

The term "pleat," as used herein, shall mean a double or fold in a garment, fabric, or an item made of cloth. The term "pleating" shall mean a process for making pleats. The term "fabric" shall mean any textile material or cloth suitable for pleating, such as textiles formed by weaving, knitting, crocheting, knotting, or felting. The term "garment" shall mean an item of clothing. Some examples of garments include dresses, gowns, skirts, kilts, blouses, slacks, shirts (including various tops, long-sleeve shirts, short-sleeve shirts, t-shirts, tank tops, crop tops, tube tops, etc.), jackets, trousers, shorts, and so forth. The garments of this disclosure include at least partially pleated fragments as described below. The pleats can be structured or patterned, but not necessarily. For example, in one embodiment, some pleats can be parallel or substantially parallel to each other; however, in another embodiment, at least some pleats are not parallel to each other. Pleats may be created in the same direction or alternative directions (e.g., in multiple directions). The scale of pleats may be even or vary. Some pleats can be structured, but others may be unstructured. For example, some pleats can be structured in a three-dimensional repeated pattern, but not necessarily.

Moreover, the pleats can be formed in certain portions (fragments) of fabric, thereby forming one-way pleated elements or two-way pleated elements. A one-way pleated element includes a fragment of garment or fabric that is pleated in a repeated manner with pleats being substantially parallel to each other. Some examples of one-way pleated elements include knife pleats, box pleats, accordion pleats, bias pleats, crystal pleats, inverted pleats, and the like. A two-way pleated element includes a fragment of garment or fabric that is pleated in a repeated manner with first pleats being substantially parallel to each other and directed in a first direction and second pleats being substantially parallel to each other and directed in a second direction, where the first direction differs from the second direction. Some examples of two-way pleated elements include zigzag pleats, basket pleats, pyramid pleats, or pleats of other geometric shapes. In yet more embodiments, the garments can include multiple-way pleated elements (e.g., two-way pleated elements, three-way pleated elements, four-way pleated elements, etc.), which generally provide any desirable three-dimensional shape. Some examples of multiple-way pleated elements include triangle-shaped pleats, diamond-shaped pleats, and randomly-shaped or randomly arranged pleats.

This disclosure relates to garments and methods of manufacturing thereof using a unique pleating method as described herein. According to various embodiments of this disclosure, the garments combine one-way pleated elements and two-way pleated elements. The pleats of the garments are not initially secured in their places but rather created in a single pleating operation as described below. The garments with the pleats formed with the methods of this disclosure provide for ease of fitting, carrying, and maintaining. Specifically, the garments can conform or expand to fit a wearer's body such that the garments fit a wide range of body shapes and sizes. The manufacturing process involves heat-treating of the pleats, which ultimately allows for the wearers hand or machine-washing of complete garments without substantial damaging of the pleats. Moreover, the overall pleating process allows for creating wrinkle-free garments or fabrics.

Now, with reference to the accompanying drawings, FIG. 1 shows a high-level block diagram of a process 100 for manufacturing a garment, according to an embodiment of this disclosure. The process commences at step A with obtaining a pattern 105 of a garment. The pattern can be a paper-based or computer-based. If it is a paper-based pattern, it includes a piece of paper with drawn lines corresponding to a pattern illustration adopted for cutting out a fabric. A virtual pattern may include a file, computer-readable data, or computer-implemented instructions storing or characterizing a drawing, illustration, or instructions controlling a manner of cutting out a fabric manually or using a cutting machine (e.g., a plotter). Each pattern 105 may be associated with a certain design of a garment and include certain types of fabric, colors, body shapes, body sizes, design features, and the like. According to certain embodiments, patterns 105 can be received from computer storage (e.g., a computer memory or database). According to certain embodiments, patterns 105 can be generated using computer-aided design software, such as Tukatech® or Gerber® fashion technology software. In either case, the patterns 105 include one or more pleated elements of garment and, therefore, require more fabric than for non-pleated garments. Accordingly, patterns 105 for pleated garments appear to be relatively large.

At step B, one or more fabrics (textiles) are cut into a plurality of fabric pieces 110 based on the pattern 105 obtained at step A. Step B can be performed by personnel, such as a sewer, using a cutting device, such as scissors, knifes, or any other automated cutting devices. In some embodiments, the fabric can be cut out by a cutting machine based on a file or commands associated with the pattern 105 obtained at step A. The cutting machine may include, for example, a fabric-cutting plotter controlled by a computer, controller, or logic elements (ASICs). The fabric-cutting plotter can be configured to cut out fabrics using a mechanical cutting tool, laser-cutting tool, and the like. As a result of cutting step B, there are provided the plurality of pieces 110 of the same or disparate fabrics, which constitute all substantial elements of a complete garment. For example, the plurality of fabric pieces 110 may include a front garment piece, back garment piece, and two sleeves (depending on a particular design of the garment). The plurality of fabric pieces 110, when combined, can cover at least one portion of wearer (e.g., at least a chest of wearer).

At step C, at least some of the plurality of fabric pieces 110 are attached together. For example, the plurality of fabric pieces 110 are sewed or stitched together. In alternative embodiments, however, the attachment of the fabric pieces 110 can be accomplished by gluing, weaving, knitting, crocheting, knotting, felting, and so forth. Once fabric pieces 110 are attached together, there is provided an unfinished garment 115, which appears to be of a relatively large size because it accounts for pleating.

At step D and step E, a pleating process is performed for the unfinished garment 115. In some embodiments, it is important for the entire process that the pleating steps D and E are performed only after (and not before) the step C, where at least some of the plurality of fabric pieces 110 are attached together into the unfinished garment 115. This allows for simplifying the overall process and combining multiple separate pleats of varying design, shape, or pattern in one garment such that pleats of one type smoothly transition into pleats of another type. For example, one garment can combine one-way and two-way pleated elements, which can be connected to each other. The period of pleating can be the same with respect to the one-way and two-way pleated elements. Thus, at least one two-way pleated element can be connected to at least one one-way pleated element without breaking a period of pleating of either pleated element.

In yet more embodiments, a garment can combine any reasonable number of multiple-way pleated elements, any reasonable number of two-way pleated elements, and/or any reasonable number of one-way pleated elements. In either case, a period of pleating of one pleated element can coincide with a period of pleating of another pleated element, or these periods can differ from each other.

Referring back to FIG. 1, at step D, there is provided at least one piece of shaped paper 120, which includes one or more pleating patterns. As shown in FIG. 1, the shaped paper 120 can have a varying pattern. For example, the shaped paper 120 includes a portion 120A for forming one-way pleated elements and a portion 120B for forming two-way pleated elements.

Accordingly, in one example, the portion 120A may be formed as a knife pleated paper with a fixed or varying period. The portion 120B may be formed as a zigzag pleated paper, where some pleats of the zigzag pattern face one direction and other pleats of the zigzag pattern face another direction (e.g., perpendicular to another direction, but not necessarily).

The unfinished garment 115 created at step C is placed or stacked onto the shaped paper 120 as shown in FIG. 1 such that the unfinished garment 115 repeats the shape of the shaped paper 120. In one embodiment, there can be provided only one piece of shaped paper 120. In another embodiment, there are provided two or more pieces of shaped paper 120 such that the unfinished garment 115 is placed between these pieces of shaped paper 120. Further, the shaped paper 120 and the unfinished garment 115 are folded and temporarily secured or held in the folded state. The folding can be performed according to a folding pattern of the shaped paper 120.

At step E, the shaped paper 120 folded together with the unfinished garment 115 are subjected to heat-treating. In particular, the shaped paper 120 folded together with the unfinished garment 115 are placed in a heater, such as a steam box, which can be filled with saturated steam (e.g., water steam or steam of an agent improving the process for forming pleats). The heating in the steam box can be performed for a predetermined period selected in the range of about 20 minutes to about 40 minutes, and at a predetermined temperature selected in the range of about 180 F to 200 F. It has been found by the inventor that these parameters of heating provide the upmost satisfactory results in the pleating process. In this process, the saturated steam permeates deep into the unfinished garment 115 such that the unfinished garment 115 comes to have permanent pleats according to the pattern and shape of the shaped paper 120.

In alternative embodiments, the heating can be performed in a press of a dye sublimation machine, thereby combining the heat-treating and coloring operation together, which facilitates the overall process. Specifically, the shaped paper 120 can be folded together with the unfinished garment 115 (and one or more dye transfer papers) are then compressed by the press of the dye sublimation machine for a predetermined time of about 1-2 minutes and at a predetermined temperature inside the press selected in the range of about 420 F to about 440 F.

After the heat-treating, the shaped paper and the unfinished garment are separated. As a result, at step I, there is formed a final garment 125. As shown in the FIG. 1, the final garment 125 includes at least one fragment 125A with one-way pleated elements (e.g., one-way, substantially parallel pleats) and at least one fragment 125B with two-way pleated elements (e.g., two-way pleats such as zigzag pleats). It shall be understood, however, that the final garment 125 may include one or more not-pleated portions (depending on a particular garment design). Moreover, the final garment 125 may include one or more multiple-way pleated elements of any suitable complex shapes and patterns. In certain embodiments, the final garment 125 includes only one-way pleated elements. In yet other embodiments, the final garment 125 includes one or more two-way pleated elements only. In yet more embodiments, the final garment 125 includes one or more multiple-way pleated elements only. The final garment 125 can possess a wrinkle-free characteristic meaning that the wearer does not need to iron the final garment 125.

At optional step F, which can be performed after steps D and E (during the step E), the final garment 125 can be colored. The coloring can be accomplished in any suitable manner (for example, dye sublimation process, direct dyeing, stock dyeing, top dyeing, yarn dyeing, warp beam dyeing, solution pigmenting, and so forth). The coloring may include attaching a single color to the final garment 125 or multiple colors to the final garment 125. In some embodiments, the coloring may involve forming images, graphics, patterns, designs, or any other color or dye features on the final garment 125.

In one example embodiment, the step F includes the process of dye sublimation. This process includes the operation of placing one or more pieces of dye sublimation heat transfer paper onto the final garment 125 and the operation of applying force to (i.e., compressing) the dye sublimation heat transfer paper with the attached final garment 125 by a machine for pressing (i.e., a press). The operation of compressing can be performed at a predetermined force selected in the range of about 3 pounds per square inch (PSI) to about 5 PSI. The operation of compressing can be also performed at a predetermined temperature of about 400 F. In some embodiments, the machine for pressing provides about 39,000 pounds of pressure between its pressing blocks. It has been found by the inventor that these parameters of pressing provide the most satisfactory results for coloring pleated materials.

In certain embodiments, the coloring step F includes using dye-sublimation printers for coloring at least certain portions of the entire garment in a predetermined manner. The dye-sublimation printer employs a printing process that uses heat to transfer one or more dyes onto the garment or fabric using a predetermined pattern or design. In yet further embodiments, the dye-sublimation printer provides simultaneous transferring of one or more dyes onto two opposite sides of the garment.

In yet further embodiments, at optional step G, there is provided a paper form of a predetermined size, shape and design for temporally attaching to the unfinished garment 115, while the unfinished garment 115 is heated at step E or step F in the steam box, press, dye sublimation printer, or machine for pressing. The paper form can be created by a plotter, which cuts out a paper of predetermined design using data created or provided by computer-aided design software. Attaching the paper form to the unfinished garment helps creating a desirable silhouette and prevents the dye from permeating the other (opposite) side of the fabric during the coloring. Notably, not all garments are made with paper forms.

In yet another optional step, there can be attached one or more additional fabric pieces to the final garment 125 after completion of the pleating process (i.e., after step I). These additional fabric pieces can be pleated or can be non-pleated fabric pieces. The additional fabric pieces can be of any type, color, and design. Moreover, there can be attached one or more buttons, zippers, fasteners, Velcro strips, sew-on snaps, and so forth. The attachment operation may include stitching, sewing, gluing, weaving, knitting, crocheting, knotting, felting, and so forth.

Thus, FIG. 1 illustrates the process for manufacturing a garment 125 having at least one one-way pleated element 125A and at least one two-way pleated element 125B, which are created during a single pleating process (i.e., in steps D and E) such that the pleats of at least one one-way pleated element 125A and the pleats of at least one two-way pleated element 125B are not secured in place. Particularly, there is no need to stitch, sew, or fix in any other way these pleats to secure them in place. Moreover, this at least one two-way pleated element 125B can be smoothly connected to the at least one one-way pleated element 125A without breaking a period of pleating of either pleating element. The pleated elements 125A and 125B provide for easy fitting and perform substantially as a wrinkle-free fabric.

Figure 2:
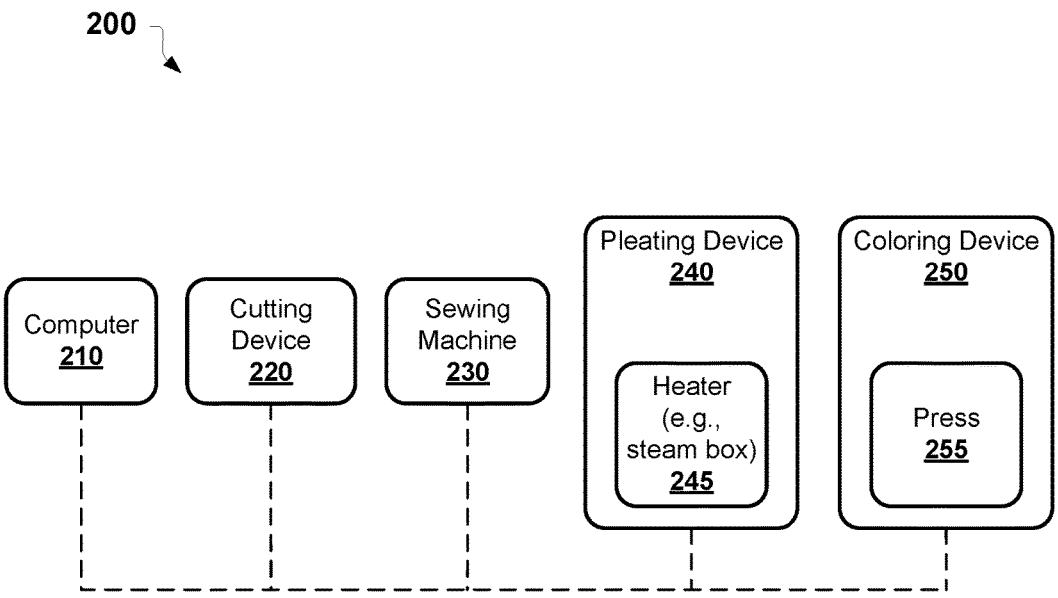
FIG. 2 shows a block diagram of a manufacturing line for manufacturing garments.

FIG. 2 shows a high-level block diagram of a manufacturing line 200 for creating garments with pleated elements, according to one example embodiment. The manufacturing line 200 includes a plurality of automated, semi-automated, and/or manual devices for performing certain manufacturing operations. As shown in the figure, the manufacturing line 200 includes a computer 210 such as a personal computer (e.g., a desktop computer, laptop computer, and tablet computer), server, cloud computing apparatus, mobile device, smart phone, computing terminal, programmable logic, ASIC, and so forth. The components of manufacturing line 200 can be operatively connected to a controlling means, which controls the operation of the entire manufacturing process as described herein. For example, the controlling means is the multifunction computer 210.

The computer 210 of FIG. 2 may include one or more processors and one or more memories. Memory may store, in part, instructions and data for execution by the processor. For example, memory of computer 210 may store one or more virtual patterns 105 or instructions for a cutting device 220 to cut out fabrics according to the patterns 105. For example, the patterns 105 can be stored in data files in the form of computer illustrations or processor-executable instructions. Memory can also store the executable code when the computer is in operation. For example, the computer 210 can control the operation of some or all devices of the manufacturing line 200. Accordingly, memory of computer 210 may store computer-executable instructions for controlling the operation of at least some or all devices of the manufacturing line 200.

The computer 210 may further include a mass storage device, portable storage medium drive, one or more output devices, one or more input devices, a network interface, and one or more peripheral devices. These components can be connected via a communications bus (data transport means).

A mass storage device of computer 210, which may be implemented with a magnetic disk drive or an optical disk drive, is a non-volatile storage device for storing data and instructions for use by a magnetic disk or an optical disk drive, which in turn may be used by a processor of computer 210. A mass storage device can store the system software for implementing embodiments described herein for purposes of loading that software into memory of computer 210. A portable storage medium drive of computer 210 can operate in conjunction with a portable non-volatile storage medium, such as a compact disk or digital video disc, to input and output data and code to and from the computer 210. The system software for implementing embodiments described herein may be stored on such a portable computer-readable medium and input to the computer 210.

Input devices of computer 210 can provide a portion of a user interface. Input devices of computer 210 may include an alphanumeric keypad, such as a keyboard, for inputting alphanumeric and other information, or a pointing device, such as a mouse, a trackball, a stylus, or cursor direction keys. Additionally, the computer 210 can include output devices such as speakers, printers, network interfaces, and monitors. A network interface of computer 210 can be utilized to communicate with other components of manufacturing line 200, one or more external devices, servers, and networked systems via one or more communications networks such as one or more wired, wireless, or optical networks including, for example, the Internet, intranet, local area network (LAN), wide area network (WAN), cellular phone networks, Bluetooth radio, and an IEEE 802.11-based radio frequency network, among others. A network interface of computer 210 may be a network interface card, such as an Ethernet card, optical transceiver, radio frequency transceiver, or any other type of device that can send and receive information.

Figure 3:
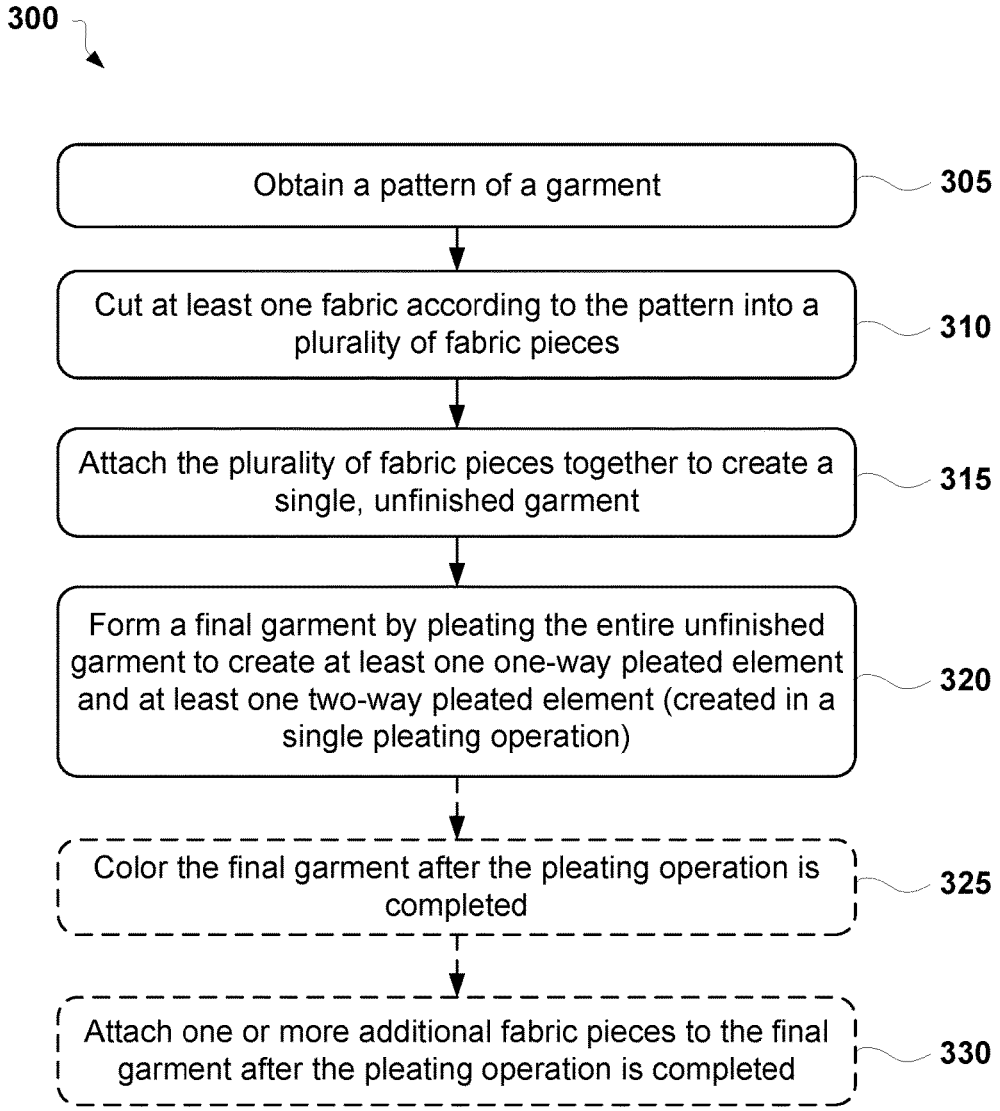
FIG. 3 shows a flow chart of a method for manufacturing a garment.

Thus, the computer 210 of FIG. 3 can be a personal computer, server, workstation, minicomputer, mainframe computer, or any other computing device. The computer 210 can also include different bus configurations, networked platforms, multi-processor platforms, and so forth. Various operating systems (OS) can be used including UNIX, Linux, Windows, Macintosh OS, Palm OS, and other suitable operating systems.

Some of the above-described functions of manufacturing line 200 may be composed of instructions that are stored on storage media (e.g., computer-readable medium). The instructions may be retrieved and executed by the processor. Some examples of storage media are memory devices, tapes, disks, and the like. The instructions are operational when executed by the processor to direct the processor to operate in accord with the disclosure. Those skilled in the art are familiar with instructions, processor(s), and storage media.

Still referring to FIG. 2, the manufacturing line 200 includes the cutting device 220 configured to cut fabrics or textile into a plurality of fabric pieces 110 according to the pattern 105. The fabric can include woven fabric, non-woven fabric, knitted fabric, netting fabric, and technical fabric. The fabric pieces 110 can of the same fabric, although, in certain embodiments, the fabric pieces 110 are of disparate fabrics.

The cutting device 220 can include scissors, a band knife, a straight knife, a fabric cutting plotter, a computerized auto cutting machine, a laser cutting machine, and so forth. In certain embodiments, the cutting device 220 can include a computing means (e.g., a controller) configured to automatically perform cutting of fabrics based on patterns 105 obtained from the computer 210 or manually inputted by an operator.

In some embodiments, the cutting device 220 can include a plotter for cutting out paper. The plotter may be necessary for making paper-based garment patterns 105 or for creating paper forms used in a machine for pressing at the heating step or the coloring step. As already discussed above, the paper forms can be temporarily attached to an unfinished garment or fabric (e.g., paper forms attached to the side, which is opposite to the side affected by the dye transferring process). The paper forms help creating a desirable silhouette and three-dimensional shapes of garments (or fabrics), and prevent the dyes from permeating the other (opposite) side of the fabric during the coloring operation.

Still referring to FIG. 2, the manufacturing line 200 includes a sewing machine 230 for sewing a plurality of fabric pieces 110 into a single, unfinished garment 115. The sewing machine 230 can include an industrial sewing machine, which can automatically sew the fabric pieces 110 into the unfinished garment 115 using a computer program or computer-readable instructions obtained from the computer 210 or manually inputted by an operator. In certain embodiments, the sewing machine 230 can be substituted with one or more gluing machines, stitching machines, knitting machines, knotting machines, weaving machines, and so forth.

Still referring to FIG. 2, the manufacturing line 200 includes a pleating device 240 for forming a final garment 125 by pleating an unfinished garment 115 to create at least one one-way pleated element 125A and at least one two-way pleated element 125B. The pleating device 240 includes one or more shape papers 120, one or more folding devices, one or more heaters 245, and one or more optional machines for pressing. As discussed above, the shape papers 120 have a specific patterned shape, such as a pleated shape. The shape papers 120 may have two or more patterned shapes of different designs. For example, the shape papers 120 may include one or more one-way pleated patterns 120A and one or more two-way pleated patterns 120B. In some embodiments, the one-way pleated pattern 120A can transition to the two-way pleated pattern 120B (e.g., such that the period of pleats of these patterns coincide and the period of pleats does not break).

The one-way pleated pattern 120A may include an accordion-shaped pleat pattern, knife-shaped pleat pattern, bias-shaped pleat pattern, box-shaped pleat pattern, crystal-shaped pleat pattern, inverted-shaped pleat pattern, and so forth. The two-way pleated pattern 120B may include a zigzag-shaped pleat pattern, wave-shaped pleat pattern, diamond-shaped pleat pattern, triangle-shaped pleat pattern, or any other three-dimensional pattern. The pleats of the shape paper 120 have a width in the range of about 0.5 inches to about 2 inches. The pleats of the shape paper 120 have a thickness in the range of about 0.5 inches to about 1 inch. The length of the pleats of the shape paper 120 can be up to the length of the fabric used or the length of unfinished garment 115; however, in certain embodiments, the length of the pleats of the shape paper 120 can be any portion of the length of unfinished garment 115. The dimensions of the shape paper 120 can be at least of the same or similar dimensions of unfinished garment 115. In certain embodiments, the shape papers 120 may include one or more multi-way pleated patterns.

There can be provided one or more folding devices adapted for folding unfinished garments 115 attached (or placed) to the shape papers 120. Thus, the unfinished garments 115 are folded to repeat the pleated shape pattern of the shape papers 120. Once folded, the folding devices are configured to hold the unfinished garments 115 attached to the shape papers 120 in the folded state. In certain embodiments, the folding devices can also twist or roll the unfinished garments 115 attached to the shape papers 120.

As discussed above, the pleating device 240 also includes a heater 245. The heater 245 can include a steam box. The steam box may be filled with saturated steam (e.g., water steam). In certain embodiments, the unfinished garment 115 folded with the shape papers 120 is placed inside the steam box for heating. As a result of heating, the unfinished garment 115 comes to have permanent pleats or folds according to the pleated shape pattern of the shape papers 120. For example, if the shape papers 120 include the one-way pleated pattern 120A and two-way pleated pattern 120B, the unfinished garment 115 transforms into the final garment 125, which includes corresponding one-way pleated element 125A and two-way pleated element 125B. The overall dimensions of the final garment 125 are smaller than the overall dimensions of the unfinished garment 115 before the pleating procedure.

The heating process in the heater 245 can be performed during a predetermined period selected in the range of about 20 minutes to about 40 minutes, and at a predetermined temperature selected in the range of 180 F to about 200 F.

In an alternative embodiment, the heating can be performed by a dye sublimation machine, which includes a press. In this example, a shaped paper folded together with an unfinished garment are compressed by the press of the dye sublimation machine, while maintaining a temperature inside the press in the range of about 420 F to about 440 F.

Still referring to FIG. 2, the manufacturing line 200 includes a coloring device 250, such as a dye sublimation device, for coloring the final garment 125 after the pleating operation is fully completed. The dye sublimation device may include a press 255, which has a support. The final garment 125 is placed on the support with one or more dye sublimation thermal transfer papers and then compressed by the press 255 with a predetermined force selected in the range of about 3 PSI to about 5 PSI. As a result, the final garment 125 is colored in a predetermined manner.

In some embodiments, coloring device 250 includes a dye-sublimation printer for coloring at least certain portions of garments or fabrics in a predetermined manner. The dye-sublimation printer can employ a printing process that uses heat to transfer one or more dyes onto the garment or fabric using a predetermined pattern or design. In some embodiments, the dye-sublimation printer provides simultaneous transferring of one or more dyes onto two opposite sides of the garment.

FIG. 3 is a process flow diagram showing a method 300 for manufacturing garments, according to an example embodiment. The method 300 may be performed by components of the manufacturing line 200. Moreover, the method 300 may have additional steps not shown herein, but which can be evident from the present disclosure. The method 300 may also have fewer steps than outlined below and shown in FIG. 3.

The method 300 commences at step 305 with the computer 210 obtaining a pattern 105 of a garment. The pattern accounts for one or more pleated elements. The pattern 105 may be a file containing a drawing or instructions as to the manner of cutting out a fabric.

At step 310, the cutting device 220 cuts at least one fabric according to the pattern 105 into a plurality of fabric pieces 110. The cutting can be manual, automatic, or semi-automatic. In one example, the cutting device 220 receives the pattern 105 from the computer 210, which controls the cutting device 220 in performing the cutting process.

At step 315, the plurality of fabric pieces 110 are attached together to create a single, unfinished garment 115. The attachment can be performed by the sewing machine 230. The sewing machine 230 can be substituted with a gluing machine, stitching machine, knitting machine, knotting machine, weaving machine, and so forth.

At step 320, a final garment 125 is formed by pleating the entire unfinished garment 115 to create at least one one-way pleated element and at least one two-way pleated element, where the at least one one-way pleated element and the at least one two-way pleated element are created in a single pleating operation. The pleating step 320 is performed by the pleating device 240, which includes the operations of stacking the entire unfinished garment 115 on a shaped paper 120, folding the shaped paper 120 with the unfinished garment 115, heating the shaped paper 120 with the unfinished garment 115 in a heater (e.g., heater 245 or press 255), and separating the unfinished garment 115 from the shaped paper 120 after heating. In certain embodiments, the pleating step 320 is performed only after the step 315 of attaching the plurality of fabric pieces into the unfinished garment. In some embodiments, the heating process includes temporally attaching one or more paper forms that facilitate creating a predetermined silhouette (shape) of the final garment 125.

The final garment 125 includes at least one one-way pleated element 125A and at least one two-way pleated element 125B. In some embodiments, pleats of one-way pleated element 125A have the width selected in the range of about 0.25 inches to about 0.5 inches, the thickness selected in the range of about 0.125 inches to about 0.75 inches, and the length selected in the range of about 5 inches to about 60 inches. Similarly, in some embodiments, pleats of two-way pleated element 125B have the width selected in the range of about 0.25 inches to about 0.5 inches, the thickness selected in the range of about 0.125 inches to about 0.5 inches, and the length selected in the range of about 0.25 inches to about 1.5 inches. Notably, the pleats of the at least one one-way pleated element 125A and pleats of the at least one two-way pleated element 125B are created without securing the pleats in place. Moreover, in certain embodiments, the two-way pleated element 125B is connected to the one-way pleated element 125A without breaking a period of pleating.

At optional step 325, the method 300 may further include coloring the final garment 125 or unfinished garment 115. Accordingly, in some embodiments, the step 325 is accomplished after the pleating step 320 is completed. In other embodiments, however, the step 325 is combined with the pleating step 320 (e.g., combined with the heating operation of the pleating step 320).

The coloring may include performing sublimation of at least one dye by attaching one or more pieces of dye sublimation heat transfer paper to the final garment 125 and compressing the dye sublimation heat transfer paper with the final garment 125 in the press 255. The coloring may include additional steps of making one or more paper forms (e.g., using a plotter) and attaching the one or more paper forms to the garment during the coloring operation.

At optional step 330, there can be attached one or more additional fabric pieces to the final garment 125. The additional fabric pieces may or may not be pleated. There can be also attached one or more fasteners (e.g., zippers, buttons, clips, etc.). The attachment of this step can include sewing, gluing, stitching, knitting, knotting, weaving, and so forth.

Thus, garments with two-way pleated elements and methods for manufacturing thereof have been described. Although embodiments have been described with reference to specific example embodiments, it will be evident that various modifications and changes can be made to these example embodiments without departing from the broader spirit and scope of the present application. Accordingly, the specification and drawings are to be regarded in an illustrative rather than a restrictive sense.

What is claimed is:

1. A method for manufacturing of a garment, the method comprising:

obtaining a pattern of the garment, wherein the pattern accounts for one or more pleated elements;

cutting at least one fabric according to the pattern into a plurality of fabric pieces;

attaching the plurality of fabric pieces together to create a single, unfinished garment; and forming a final garment by pleating a first portion of the unfinished garment to create at least one one-way pleated element and pleating a second portion of the unfinished garment to create at least one two-way pleated element, wherein the at least one one-way pleated element and the at least one two-way pleated element are created in a single pleating operation without overlapping each other.

2. The method of claim 1, wherein pleats of the at least one one-way pleated element and pleats of the at least one two-way pleated element are created without securing the pleats in place.

3. The method of claim 1, wherein the pleating operation is performed only after the attachment of the plurality of fabric pieces into the unfinished garment.

4. The method of claim 1, further comprising attaching one or more additional fabric pieces to the final garment after the pleating operation.

5. The method of claim 1, wherein the pleating of the entire unfinished garment includes:

stacking the entire unfinished garment on a shaped paper;

folding the shaped paper together with the entire unfinished garment;

heating the shaped paper with the entire unfinished garment in a heater; and separating the entire unfinished garment from the shaped paper after the heating operation.

6. The method of claim 5, wherein the heating includes heating in a steam box during a predetermined period being in a range from about 20 minutes to about 40 minutes and at a predetermined temperature being in a range from about 180 F to about 200 F.

7. The method of claim 5, wherein the heating includes compressing the shaped paper together with the entire unfinished garment by a press during a predetermined period being in a range from about 1 minute to about 2 minutes and at a predetermined temperature being in a range from about 420 F to about 400 F.

8. The method of claim 1, further comprising coloring of the final garment.

9. The method of claim 8, wherein the coloring is performed during the pleating operation.

10. The method of claim 8, wherein the coloring is performed after the pleating operation is fully completed.

11. The method of claim 8, wherein the coloring includes performing sublimation of at least one dye by attaching one or more pieces of dye sublimation heat transfer paper to the final garment, and compressing the one or more pieces of dye sublimation heat transfer paper with the final garment in a press.

12. The method of claim 11, further comprising attaching a paper form of a predetermined shape to the final garment before the compressing, wherein the paper form facilitates creating a predetermined silhouette of the final garment.

13. The method of claim 8, wherein the coloring includes performing sublimation of at least one dye by attaching one or more pieces of dye sublimation heat transfer paper to the unfinished garment, and compressing the one or more pieces of dye sublimation heat transfer paper with the unfinished garment in a press.

14. The method of claim 13, further comprising attaching a paper form of a predetermined shape to the unfinished garment before the compressing, wherein the paper form facilitates creating a predetermined silhouette of the final garment.

15. The method of claim 1, wherein the at least one one-way pleated element includes a fragment of the final garment, which is pleated in a repeated manner with pleats being substantially parallel to each other.

16. The method of claim 1, wherein the at least one two-way pleated element includes a fragment of the final garment, which is pleated in a repeated manner with first pleats being substantially parallel to each other and directed in a first direction and second pleats being substantially parallel to each other and directed in a second direction.

17. The method of claim 1, wherein the at least one two-way pleated element includes a fragment of the final garment having zigzag pleats, basket pleats, or pyramid pleats.

18. The method of claim 1, wherein the at least one two-way pleated element is connected to the at least one one-way pleated element without breaking a period of pleating.

* * * * *